US007461746B1

(12) United States Patent
Egge et al.

(10) Patent No.: US 7,461,746 B1
(45) Date of Patent: Dec. 9, 2008

(54) PORTABLE SCREENING/WASHING PLANT WITH SCRUBBING MILL

(75) Inventors: Alan R. Egge, Yankton, SD (US); Steve J. Anderson, Yankton, SD (US); Jeffrey A. Wendte, Yankton, SD (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 11/820,421

(22) Filed: Jun. 19, 2007

Related U.S. Application Data

(60) Provisional application No. 60/814,762, filed on Jun. 19, 2006.

(51) Int. Cl.
*B07B 1/00* (2006.01)

(52) U.S. Cl. ..... 209/413; 209/268; 209/420

(58) Field of Classification Search ..... 209/44, 209/44.2, 250, 268, 413, 420, 421, 935
See application file for complete search history.

(56) References Cited

U.S. PATENT DOCUMENTS

| | | | | | |
|---|---|---|---|---|---|
| 3,439,806 | A * | 4/1969 | Kass et al. | 209/260 |
| 3,909,401 | A * | 9/1975 | Thompson | 209/412 |
| 4,256,572 | A | 3/1981 | Read | |
| 4,785,761 | A * | 11/1988 | Greenbank | 118/682 |
| 4,923,597 | A | 5/1990 | Anderson et al. | |
| 4,956,078 | A | 9/1990 | Magerowski et al. | |
| 5,049,261 | A * | 9/1991 | Tapp et al. | 209/17 |
| 5,106,490 | A | 4/1992 | McDonald | |
| 5,232,098 | A | 8/1993 | St-Pierre et al. | |
| 5,234,564 | A | 8/1993 | Smith | |
| 5,287,975 | A * | 2/1994 | Chumley et al. | 209/3 |
| 5,362,193 | A * | 11/1994 | Milstead | 414/332 |
| 5,469,972 | A | 11/1995 | St-Pierre et al. | |
| 6,152,308 | A * | 11/2000 | Kreiser et al. | 209/421 |
| 6,382,424 | B1 | 5/2002 | Bolton et al. | |
| 6,698,594 | B2 * | 3/2004 | Cohen et al. | 209/421 |
| 6,752,339 | B2 * | 6/2004 | Moriya et al. | 241/101.74 |
| 6,820,749 | B2 | 11/2004 | Brock et al. | |
| 6,843,376 | B2 * | 1/2005 | Dube et al. | 209/421 |
| 6,923,393 | B1 * | 8/2005 | Neier et al. | 241/30 |
| 6,955,311 | B2 * | 10/2005 | Moro et al. | 241/101.741 |
| 6,988,624 | B2 | 1/2006 | MacNaughton | |
| 7,093,719 | B2 * | 8/2006 | Roper | 209/420 |
| 2004/0026342 | A1 | 2/2004 | O'Brien et al. | |
| 2006/0266676 | A1 * | 11/2006 | Bossen | 209/293 |

FOREIGN PATENT DOCUMENTS

| | | |
|---|---|---|
| GB | 7141 | 0/1915 |
| SU | 1606186 | 11/1990 |

* cited by examiner

*Primary Examiner*—Joseph C Rodriguez
(74) *Attorney, Agent, or Firm*—Chambliss, Bahner & Stophel, P.C.

(57) ABSTRACT

A portable screening and washing assembly includes a frame, and in addition, a scrubbing mill, a vibratory screen assembly and a fine material washer, all of which are mounted on the frame. Both the scrubbing mill and the fine material washer are adapted to move between a transport configuration and an operational configuration.

20 Claims, 3 Drawing Sheets

PORTABLE SCREENING/WASHING PLANT WITH SCRUBBING MILL

CROSS REFERENCE TO RELATED APPLICATION

This application claims the benefit of provisional Application No. 60/814,762, which was filed on Jun. 19, 2006.

FIELD OF THE INVENTION

This invention relates generally to a portable washing and screening plant for cleaning, rinsing and sizing stone and sand products. More particularly, the invention relates to an assembly of various components that are used to wash, screen and separate stone and sand products from an aggregate mixture. This assembly may be transported on the highway in a transport configuration behind a tractor and subsequently converted to an operational configuration.

BACKGROUND AND DESCRIPTION OF THE PRIOR ART

Plants for the washing and screening of stone and sand products are known and generally comprise one or more washers and a vibrating screen assembly. It is also known to mount these washing and screening components onto one or more vehicles or trailers in a transport configuration for transport of the assembly on the highway. A conventional trailer-mounted washing and screening plant comprises a vibratory screen assembly mounted over a fine material washer. Some washing and screening plants also incorporate an aggregate scrubber that processes material prior to the vibratory screen assembly. These combination plants typically must be transported in multiple trailer loads. Furthermore, the assembly for a plant of significant capacity is generally so massive that either a crane is required to raise one or more operating components of the assembly from the transport configuration to the operational configuration or some of the operating components must be removed from the assembly in order to convert it from the operational configuration to the transport configuration and from the transport configuration to the operational configuration.

It would be desirable if a portable washing and screening plant assembly could be provided that could be moved between the transport configuration and the operational configuration without requiring the use of an external crane. It would also be desirable if such an assembly could be provided that could be converted from the operational configuration to the transport configuration and from the transport configuration to the operational configuration without first removing one or more operating components from the assembly. In addition, it would be desirable if the transport configuration of such an assembly was of such dimensions and such weight as to be legally transportable on state-regulated highways.

ADVANTAGES OF THE INVENTION

Among the advantages of the invention is that it provides a washing and screening plant assembly that is portable. Another advantage of the invention is that it provides such an assembly that can be moved between the transport configuration and the operational configuration without requiring the use of an external crane. Another advantage is that such assembly can be converted from the operational configuration to the transport configuration and from the transport configuration to the operational configuration without first removing one or more operating components from the assembly.

Additional advantages of the invention will become apparent from an examination of the drawings and the ensuing description.

EXPLANATION OF TECHNICAL TERMS

As used herein, the term "actuator" refers to a device that imparts linear or rotational motion to a component. The term "actuator" thus includes hydraulic actuators or cylinders, pneumatic actuators, motors, motorized drives, levers, springs, gear systems and combinations thereof.

As used herein, the term "aggregate material" and similar terms refer to stone, gravel, sand and other similar particulate materials of various sizes.

As used herein, the term "front" and similar terms, when used in reference to a vehicle, refers to the end of the vehicle where the operator's cab is located. When used in reference to a trailer that is adapted to be pulled or towed by a vehicle, the term "front" refers to the end of the trailer nearest the cab of the vehicle when the trailer is attached to the vehicle.

As used herein, the term "rear" and similar terms, when used in reference to a vehicle (or to a trailer that is adapted to be pulled or towed by a vehicle), refers to the end of the vehicle (or the trailer) opposite the front end.

As used herein, the term "lower" and similar terms, when used in reference to a vehicle or trailer, refers to the part of the vehicle or trailer nearest the roadway or the ground.

As used herein, the term "upper", when used in reference to a vehicle or trailer, refers to the part of the vehicle or trailer opposite the lower part.

SUMMARY OF THE INVENTION

The invention comprises an assembly of operating components of a washing and screening plant comprising a scrubbing mill, a vibratory screen and a fine material washer. The assembly is mounted on a vehicle, or a trailer that may be pulled by a vehicle, when the components are in a transport configuration. The assembly may be converted from the transport configuration to an operational configuration without the assistance of an external crane.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 2:
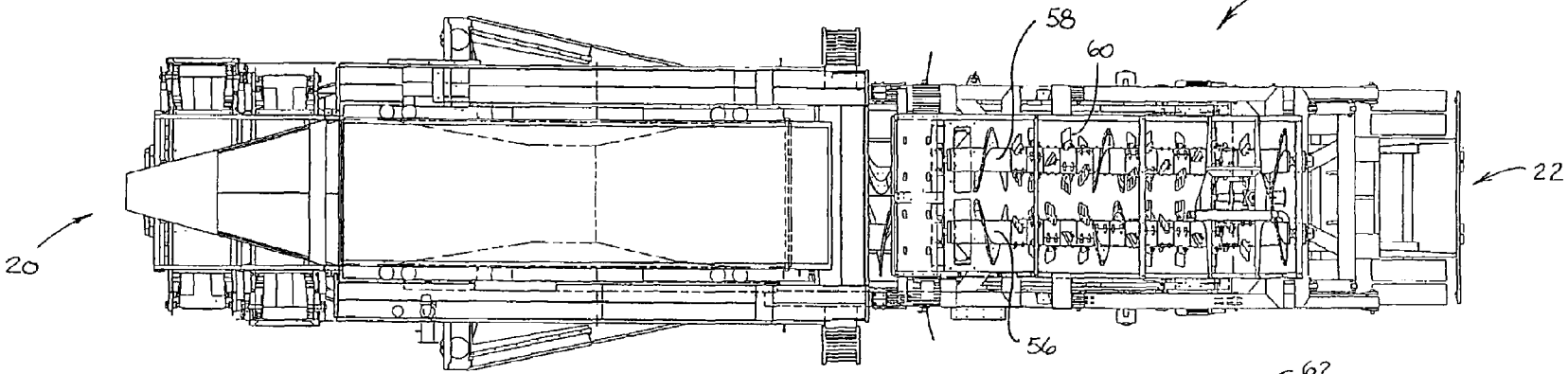
FIG. 2 illustrates a top view of the first embodiment of the invention with the assembly in the transport configuration.
Figure 1:
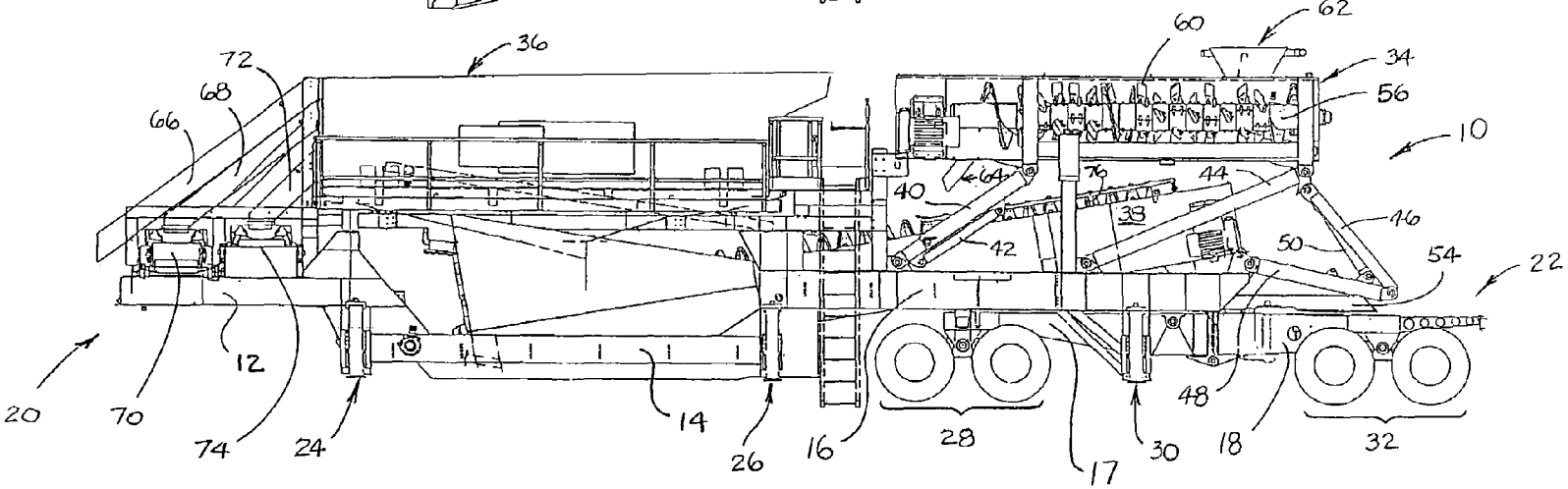
FIG. 1 illustrates a side view of a first embodiment of the invention with the assembly in the transport configuration.
Figure 4:
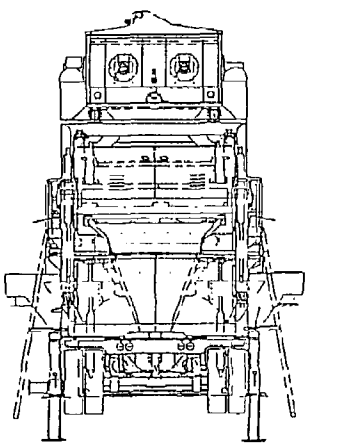
FIG. 4 illustrates an end view of the assembly of FIG. 3.
Figure 3:
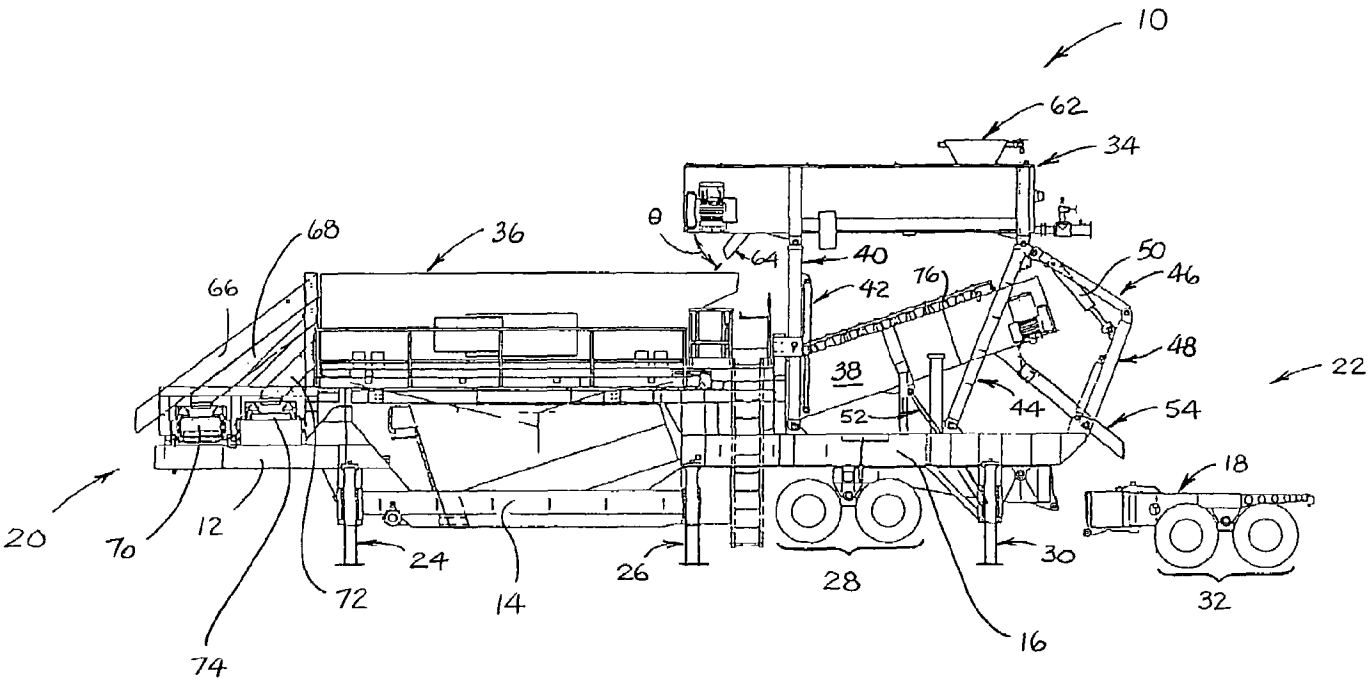
FIG. 3 illustrates a side view of the first embodiment of the invention with the assembly in the operational configuration.

Referring now to FIGS. 1-4, a first embodiment of the invention, assembly 10, comprises a trailer frame including first frame component 12, second frame component 14, third frame component 16, and a fourth frame component comprising front equalizer frame portion 17 and rear equalizer frame portion 18 which are removably joined together (as best shown by comparing FIGS. 1 and 3). Assembly 10 has a front end 20 and a rear end 22. Mounted to second trailer frame component 14 is a pair of front trailer supports (one of which, support 24, is shown in the drawings) and a pair of intermediate trailer supports (one of which, support 26, is shown in the drawings). Attached to third trailer frame component 16 is a pair of rear trailer supports (one of which, support 30, is shown in the drawings). Attached to front equalizer frame portion 17 is wheelset 28 and attached to rear equalizer frame portion 18 is wheelset 32. Front equalizer frame portion 17 and rear equalizer frame portion 18 are both attached to third frame component 16, although, as shown in FIG. 3, rear equalizer frame portion 18 is preferably detachably mounted both to the front equalizer frame portion and to third frame component 16. Attached to and mounted on the trailer are scrubbing mill 34, vibratory screen assembly 36 and fine material washer 38.

As shown by comparing FIGS. 1 and 3, the preferred scrubbing mill of first embodiment 10 is raised from the transport configuration (shown in FIG. 1) to the operational configuration (shown in FIG. 3) by the cooperation of a front and a rear elevation assembly. Preferably, the front elevation assembly includes a pair of scrubbing mill supports comprising telescoping tube supports and cooperating actuators. Preferably, the telescoping tube supports are comprised of a pair of square tubes, with an inner tube mounted within the outer tube and adapted to move longitudinally with respect thereto. One end of each tube support (such as tube support 40) is pivotally attached to third trailer frame component 16, and the other end of each tube support is pivotally attached to scrubbing mill 34. Preferably, each cooperating actuator comprises a hydraulic or pneumatic cylinder that is adapted to be extended to cause the tube support to pivot from an angled position when the scrubbing mill is in the transport configuration to a generally vertical position when the scrubbing is in the operational configuration. A cooperating actuator of this type (such as actuator 42) is attached at one end to the outer tube of its associated telescoping tube support, and the other end is attached to the inner tube of the tube support, so that extension and retraction of the actuator will cause the tubes of the tube support to telescope with respect to each other. As shown by comparing FIGS. 1 and 3, extension of actuator 42 (in cooperation with the operation of the rear elevation assembly) will cause tube support 40 to pivot from the angled position shown in FIG. 1 to the generally vertical (or upright) position shown in FIG. 3 as the inner telescoping tube of tube support 40 extends out of the outer tube.

Preferably, the rear elevation assembly of first embodiment 10 comprises a pair of actuators which cooperate with a linkage assembly. The preferred linkage assembly of this embodiment includes a pair of forward links (one of which, link 44, is shown in FIGS. 1 and 3), a pair of upper rear links (one of which, link 46, is shown in FIGS. 1 and 3) and a pair of lower rear links (one of which, link 48, is shown in FIGS. 1 and 3). Forward link 44 is pivotally attached at one end to third trailer frame component 16 and at the other end to scrubbing mill 34. One end of upper rear link 46 is pivotally attached to scrubbing mill 34 and the other end is pivotally attached to one end of lower rear link 48. The other end of lower rear link 48 is pivotally attached to third trailer frame component 16. A pair of actuators (one of which, actuator 50, is shown in FIGS. 1 and 3) may be extended to cooperate with the linkage assembly (and the front elevation assembly) to move the scrubbing mill between the transport configuration shown in FIG. 1 and the operational configuration shown in FIG. 3.

Fine material washer 38 is preferably pivotally attached to the trailer frame so that when the scrubbing mill is raised from the transport configuration to the operational configuration, a pair of actuators (one of which, actuator 52, is shown in FIG. 3) may be operated to raise the rear end of the fine material washer to the orientation shown in FIG. 3. Pivotally attached to the rear of fine material washer 38 is chute 54, so that as the rear end of the fine material washer is raised to the operational configuration, the chute will extend beyond the rear end of third trailer frame component 16, as shown in FIG. 3.

The scrubbing mill is preferably a blademill which includes a pair of augers 56 and 58 with paddle assemblies 60 mounted thereon. The blademill serves to break up soluble mud, clay and agglomerations contained in an aggregate slurry mixture that is admitted to the blademill through hopper 62, so that a processed aggregate mixture may be discharged into the vibratory screen assembly. The processed aggregate mixture is discharged from the front end of the blademill through chute 64 into vibratory screen assembly 36. Because of the elevation of the blademill above vibratory screen assembly 36 in the operational configuration, chute 64 may be disposed at an angle $\theta$ that provides for proper operation of the assembly. Preferably, the bottom of the blademill is at least about two feet above the top of vibratory screen assembly 36 in the operational configuration shown in FIG. 3, and angle $\theta$ is within the range of 35° to 65°, most preferably about 50°.

Vibratory screen assembly 36 is preferably a triple-deck screen that is used to separate aggregate materials of various particle sizes from the processed aggregate mixture flowing out of chute 64 from the blademill. Oversized materials that are retained on the top screen may be discharged through chute 66. Materials that pass through the top screen but are retained on the middle screen are discharged through chute 68 onto conveyor 70. Materials that pass through the top and middle screens but are retained on the bottom screen are discharged through chute 72 onto conveyor 74. Materials that pass through all of the screens of the screen assembly are discharged into the front of fine material washer 38. The fine material washer includes a pair of augers (one of which, auger 76, is shown in FIGS. 1 and 3) which act to "dewater" the remaining fine particulate material in the slurry to produce a fine aggregate that is discharged through chute 54.

When trailer assembly 10 is towed to the operating position and disengaged from the tractor (not shown), rear equalizer frame portion 18 may be detached from the front equalizer frame portion and from third frame component 16 as shown in FIG. 3. Then front trailer support 24, intermediate trailer support 26 and rear trailer support 30 may be extended as shown in FIG. 3 by extending internal actuators (not shown) to raise the frame assembly and provide a stable base for operations. Thereafter, the scrubbing mill and fine material washer may be raised from the transport configuration shown in FIG. 1 to the operational configuration shown in FIG. 3.

Figure 6:
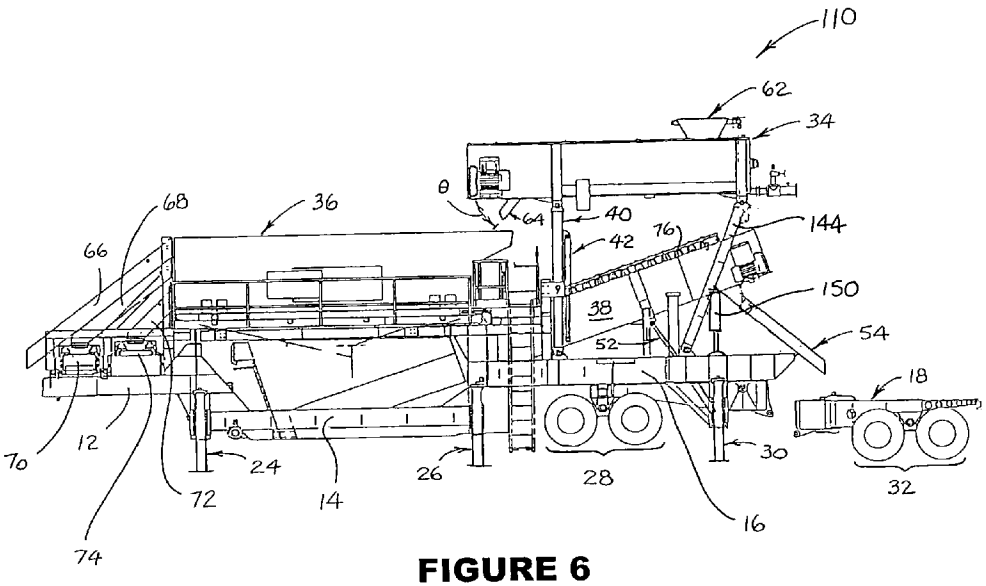
FIG. 6 illustrates a side view of the second embodiment of the invention with the assembly in the operational configuration.
Figure 5:
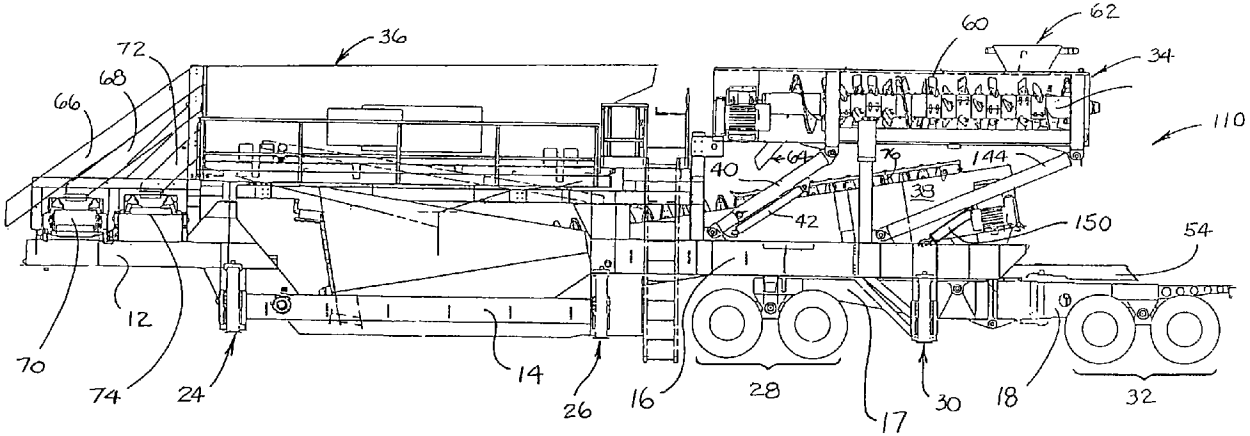
FIG. 5 illustrates a side view of a second embodiment of the invention with the assembly in the transport configuration.

A second embodiment of the invention, assembly 110, is illustrated in FIGS. 5-6. This embodiment is essentially identical to assembly 10 except for the rear elevation assembly. Thus, as shown in FIGS. 5 and 6, assembly 110 comprises a trailer frame which preferably includes first frame component 12, second frame component 14, third frame component 16 and a fourth frame component that comprises front equalizer frame portion 17 and rear equalizer frame portion 18 which are removably joined together. Mounted to second trailer frame component 14 is a pair of front trailer supports (one of which, support 24, is shown in the drawings) and a pair of intermediate trailer supports (one of which, support 26, is shown in the drawings). Attached to third trailer frame component 16 is a pair of rear trailer supports (one of which, support 30, is shown in the drawings). Attached to front equalizer frame portion 17 is wheelset 28 and attached to rear equalizer frame portion 18 is wheelset 32. Front equalizer frame portion 17 and rear equalizer frame portion 18 are both attached to third frame component 16, although the rear equalizer frame portion is preferably detachably mounted both to the front equalizer frame portion and to third frame component 16. Attached to and mounted on the trailer are scrubbing mill 34, vibratory screen assembly 36 and fine material washer 38.

As shown by comparing FIGS. 5 and 6, the scrubbing mill of second embodiment 110 is raised from the transport configuration (shown in FIG. 5) to the operational configuration (shown in FIG. 6) by the cooperation of a front and a rear elevation assembly. Preferably, the front elevation assembly is identical to that of assembly 10. Thus, the front elevation assembly of the second embodiment of the invention includes a pair of scrubbing mill supports comprising telescoping tube supports and cooperating actuators. Preferably, the telescoping tube supports are comprised of a pair of square tubes, with an inner tube mounted within the outer tube and adapted to move longitudinally with respect thereto. One end of each tube support (such as tube support 40) is pivotally attached to third trailer frame component 16, and the other end of each tube support is pivotally attached to scrubbing mill 34. A cooperating actuator (such as actuator 42) is attached at one end to the outer tube of its associated telescoping tube support, and the other end is attached to the inner tube of the tube support, so that extension and retraction of the actuator will cause the tubes of the tube support to telescope with respect to each other. As shown by comparing FIGS. 5 and 6, extension of actuator 42 (in cooperation with the operation of the rear elevation assembly) will cause tube support 40 to pivot from the angled position shown in FIG. 5 to the upright position shown in FIG. 6 as the inner telescoping tube of tube support 40 extends out of the outer tube.

Preferably, the rear elevation assembly of second embodiment 110 comprises a pair of actuators which cooperate with a linkage assembly. The preferred linkage assembly of this embodiment includes a pair of forward links (one of which, link 144, is shown in FIGS. 5 and 6). Forward link 144 is pivotally attached at one end to third trailer frame component 16 and at the other end to scrubbing mill 34. A pair of actuators (one of which, actuator 150, is shown in FIGS. 5 and 6) are attached between third trailer frame component 16 and the forward links. These actuators may be extended to cooperate with the linkage assembly (and the front elevation assembly) to move the scrubbing mill between the transport configuration shown in FIG. 5 and the operational configuration shown in FIG. 6.

When trailer assembly 110 is towed to the operating position and disengaged from the tractor (not shown), rear equalizer frame portion 18 may be detached from the front equalizer frame portion and from third frame component 16 as shown in FIG. 6. Then front trailer support 24, intermediate trailer support 26 and rear trailer support 30 may be extended as shown in FIG. 6 by extending internal actuators (not shown) to raise the frame assembly and provide a stable base for operations. Thereafter, the scrubbing mill and fine material washer may be raised from the transport configuration shown in FIG. 5 to the operational configuration shown in FIG. 6.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, as would be understood by those having ordinary skill in the art to which the invention relates.

What is claimed is:

1. A portable screening and washing assembly comprising:

(a) a frame having a wheelset;

(b) a scrubbing mill that is mounted on the frame and adapted to move between a transport configuration and an operational configuration;

(c) a vibratory screen assembly that is mounted on the frame;

(d) a fine material washer that is mounted on the frame and adapted to move between a transport configuration and an operational configuration;

(e) means mounted on the frame for moving the scrubbing mill between the transport configuration and the operational configuration;

(f) means mounted on the frame for moving the fine material washer between the transport configuration and the operational configuration.

2. The assembly of claim 1 wherein:

(a) the fine material washer has a front end and a rear end, said front end being pivotally attached to the frame; and (b) the means mounted on the frame for moving the fine material washer between the transport configuration and the operational configuration includes a pair of actuators, one on either side of the fine material washer, each of which is pivotally attached at one end to the frame and at the other end to the fine material washer so that when the scrubbing mill is raised from the transport configuration to the operational configuration, the actuators may be operated to raise the rear end of the fine material washer to the operational configuration.

3. The assembly of claim 2:

(a) wherein the frame comprises:

(i) a first frame component that is located generally beneath the vibratory screen assembly;

(ii) a second frame component that is located to the rear of the first frame component and generally beneath the vibratory screen assembly;

(iii) a third frame component having a front end and a rear end, said third frame component being located to the rear of the second frame component and generally beneath the fine material washer;

(b) which includes a chute that is pivotally attached to the rear end of the fine material washer so that as the rear end of the fine material washer is raised to the operational configuration, the chute will extend beyond the rear end of the third frame component.

4. The assembly of claim 1 wherein the frame comprises:
(a) a first frame component that is located generally beneath the vibratory screen assembly;
(b) a second frame component that is located to the rear of the first frame component and generally beneath the vibratory screen assembly;
(c) a third frame component that is located to the rear of the second frame component and generally beneath the fine material washer; and
(d) a fourth frame component.

5. The assembly of claim 4 wherein the fourth frame component comprises:
(a) a front equalizer frame portion to which a wheelset is attached; and
(b) a rear equalizer frame portion to which a wheelset is attached.

6. The assembly of claim 5 wherein the rear equalizer frame portion is detachably mounted both to the front equalizer frame portion and to the third frame component.

7. The assembly of claim 1 wherein:
(a) the means mounted on the frame for moving the scrubbing mill between the transport configuration and the operational configuration includes a front elevation assembly comprising a pair of scrubbing mill supports, one on either side of the scrubbing mill, wherein each scrubbing mill support comprises:
(i) a telescoping tube support comprising an inner tube mounted within an outer tube and adapted to move longitudinally with respect thereto, said telescoping tube support being pivotally attached at one end to the frame and being pivotally attached at the other end to the scrubbing mill; and
(ii) a cooperating actuator that is attached at one end to the outer tube and at the other end to the inner tube, so that operation of the actuator will cause the inner tube to move longitudinally with respect to the outer tube; and
(b) the means mounted on the frame for moving the scrubbing mill between the transport configuration and the operational configuration includes a rear elevation assembly that is attached between the frame and the scrubbing mill.

8. The assembly of claim 7 wherein the cooperating actuator of each scrubbing mill support is adapted to be extended to cause the tube support to pivot from an angled position when the scrubbing mill is in the transport configuration to a generally vertical position when the scrubbing is in the operational configuration.

9. The assembly of claim 7 wherein the rear elevation assembly comprises:
(a) a linkage assembly comprising:
(i) a pair of forward links, one on either side of the scrubbing mill, each of which is pivotally attached at one end to the frame and pivotally attached at the other end to the scrubbing mill;
(ii) a pair of lower rear links, one on either side of the scrubbing mill, each of which is pivotally attached at one end to the frame; and
(iii) a pair of upper rear links, one on either side of the scrubbing mill, each of which is pivotally attached at one end to a lower rear link and pivotally attached at the other end to the scrubbing mill; and
(b) a pair of actuators which cooperate with the linkage assembly, one on either side of the scrubbing mill, each of which is pivotally attached at one end to the frame and pivotally attached at the other end to the scrubbing mill, so that operation of the actuators will, with the cooperation of the linkage assembly and the front elevation assembly, move the scrubbing mill between the transport configuration and the operational configuration.

10. The assembly of claim 7 wherein the rear elevation assembly comprises:
(a) a linkage assembly comprising a pair of forward links, one on either side of the scrubbing mill, each of which is pivotally attached at one end to the frame and pivotally attached at the other end to the scrubbing mill; and
(b) a pair of actuators which cooperate with the linkage assembly, one on either side of the scrubbing mill, each of which is pivotally attached at one end to the frame and pivotally attached at the other end to a forward link, so that operation of the actuators will, with the cooperation of the linkage assembly and the front elevation assembly, move the scrubbing mill between the transport configuration and the operational configuration.

11. A portable screening and washing assembly having a front end and a rear end, said assembly comprising:
(a) a frame having a wheelset;
(b) a scrubbing mill that is mounted on the frame and adapted to move between a transport configuration and an operational configuration; said scrubbing mill being:
(i) mounted above the fine material washer in the transport configuration;
(ii) mounted nearer to the rear end than the front end;
(iii) adapted, in the operational configuration, to process an aggregate slurry mixture, thereby producing a processed aggregate mixture;
(iv) adapted, in the operational configuration, to discharge the processed aggregate mixture into the vibratory screen assembly;
(c) a vibratory screen assembly that is mounted on the frame, said vibratory screen assembly being:
(i) mounted nearer to the front end than the rear end;
(ii) adapted, in the operational configuration, to separate aggregate materials of various particle sizes from the processed aggregate mixture discharged from the scrubbing mill;
(iii) adapted, in the operational configuration, to discharge aggregate materials into the fine material washer;
(d) a fine material washer that is mounted on the frame and adapted to move between a transport configuration and an operational configuration, said fine material washer being:
(i) adapted to dewater aggregate materials received from the vibratory screen assembly;
(ii) mounted nearer to the rear end than the front end.

12. The assembly of claim 11 wherein the scrubbing mill comprises a blademill having a pair of augers with paddle assemblies mounted thereon.

13. The assembly of claim 11 wherein the vibratory screen assembly comprises a triple deck screen.

14. The assembly of claim 11 wherein the fine material washer comprises a pair of augers.

15. The assembly of claim 11 wherein the scrubbing mill includes a scrubbing mill hopper for introduction of the aggregate slurry mixture and a scrubbing mill chute through which the processed aggregate mixture may be discharged into the vibratory screen assembly.

16. The assembly of claim 15 wherein the scrubbing mill chute is disposed at an angle within the range of 35° to 65° when the scrubbing mill is in the operational configuration.

17. A portable screening and washing assembly comprising:

(a) a frame having:

(i) a front end;

(ii) a rear end; and (iii) a wheelset;

(b) a scrubbing mill that is:

(i) mounted on the frame;

(ii) adapted to move between a transport configuration and an operational configuration;

(iii) mounted above the fine material washer in the transport configuration;

(iv) adapted, in the operational configuration, to process an aggregate slurry mixture, thereby producing a processed aggregate mixture;

(v) adapted, in the operational configuration, to discharge the processed aggregate mixture into the vibratory screen assembly;

(c) a vibratory screen that is:

(i) mounted on the frame;

(ii) adapted, in the operational configuration, to separate aggregate materials of various particle sizes from the processed aggregate mixture discharged from the scrubbing mill;

(iii) adapted, in the operational configuration, to discharge aggregate materials into the fine material washer;

(d) a fine material washer that is:

(i) mounted on the frame;

(ii) adapted to move between a transport configuration and an operational configuration;

(iii) adapted to dewater aggregate materials received from the vibratory screen assembly;

(e) means mounted on the frame for moving the scrubbing mill between the transport configuration and the operational configuration;

(f) means mounted on the frame for moving the fine material washer between the transport configuration and the operational configuration.

18. The assembly of claim 17 wherein the scrubbing mill includes a scrubbing mill hopper for introduction of the aggregate slurry mixture and a scrubbing mill chute through which the processed aggregate mixture may be discharged into the vibratory screen assembly.

19. The assembly of claim 18 wherein the scrubbing mill chute is disposed at an angle within the range of 35° to 65° when the scrubbing mill is in the operational configuration.

20. The assembly of claim 18 which is sized and configured, when in the transport configuration, to be transportable over state-regulated highways.

* * * * *